US005197613A

United States Patent [19]

Kotlowski

[11] Patent Number: 5,197,613

[45] Date of Patent: Mar. 30, 1993

[54] MULTIPLE LAUNDRY BASKET APPARATUS

[76] Inventor: Mark A. Kotlowski, 1009 Smedal Dr., Stoughton, Wis. 53589

[21] Appl. No.: 719,640

[22] Filed: Jun. 24, 1991

[51] Int. Cl.[5] ..... A47F 5/00

[52] U.S. Cl. ..... 211/133; 211/81; 211/170

[58] Field of Search ..... 211/133, 126, 170, 71, 211/81, 150

[56] References Cited

U.S. PATENT DOCUMENTS

| | | | |
|---|---|---|---|
| 2,326,710 | 8/1943 | Waycott | 211/81 |
| 4,501,369 | 2/1985 | Fox | 211/133 |
| 4,744,474 | 5/1988 | Tallvirg | 211/133 |
| 4,984,704 | 1/1991 | O'Malley | 211/81 X |
| 5,000,329 | 3/1991 | Luberto | 211/133 X |
| 5,090,587 | 2/1992 | Brown | 211/81 X |

*Primary Examiner*—Robert W. Gibson, Jr.

[57] ABSTRACT

A plurality of vertical support posts pivotally mount a plurality of vertically stacked baskets therebetween to permit ease of pivotment of each basket and removal of garments contained therewithin into an underlying hamper.

3 Claims, 5 Drawing Sheets 18
21
15
18
11
11
20
23
19
25
22

10a
33
32
34
29
11a
11a
29
28
27
12a
26
12a
31
31
30

MULTIPLE LAUNDRY BASKET APPARATUS

BACKGROUND OF THE INVENTION

1. Field of the Invention

The field of invention relates to laundry basket apparatus, and more particularly pertains to a new and improved multiple laundry basket apparatus wherein the same is mounted for vertical orientation and ease of removal of contents from each basket.

2. Description of the Prior Art

Laundry basket apparatus is arranged in a vertical orientation as set forth in the instant invention to provide compactness and storage of various categories of laundry garments. The prior art has typically utilized multiple baskets arranged in a horizontal array to mount laundry components therewithin as exemplified in U.S. Pat. No. 3,995,924 to Jones wherein various baskets are arranged within a central compartment in a horizontal array.

U.S. Pat. No. 4,585,283 to Redmond, et al. sets forth a multiple bag laundry hamper, wherein the hamper utilizes a framework to mount a horizontal array of basket members.

U.S. Pat. No. 2,736,454 to McConnell sets forth a compartmented clothes hamper providing various pie-shaped baskets contained therewithin.

As such, it may be appreciated that there continues to be a need for a new and improved multiple laundry basket apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of laundry basket apparatus now present in the prior art, the present invention provides a multiple laundry basket apparatus wherein the same pivotally mounts a vertical array of laundry baskets for ease and compactness of storage of various laundry garments. As such, the general purpose of the present invention, which will be described subsequently in greater detail, is to provide a new and improved multiple laundry basket apparatus which has all the advantages of the prior art laundry basket apparatus and none of the disadvantages.

To attain this, the present invention provides a plurality of vertical support posts pivotally mounting a plurality of vertically stacked baskets therebetween to permit ease of pivotment of each basket and removal of garments contained therewithin into an underlying hamper.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple laundry basket apparatus which has all the advantages of the prior art laundry basket apparatus and none of the disadvantages.

It is another object of the present invention to provide a new and improved multiple laundry basket apparatus which may be easily and efficiently manufactured and marketed.

It is a further object of the present invention to provide a new and improved multiple laundry basket apparatus which is of a durable and reliable construction.

An even further object of the present invention is to provide a new and improved multiple laundry basket apparatus which is susceptible of a low cost of manufacture with regard to both materials and labor, and which accordingly is then susceptible of low prices of sale to the consuming public, thereby making such multiple laundry basket apparatus economically available to the buying public.

Still yet another object of the present invention is to provide a new and improved multiple laundry basket apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
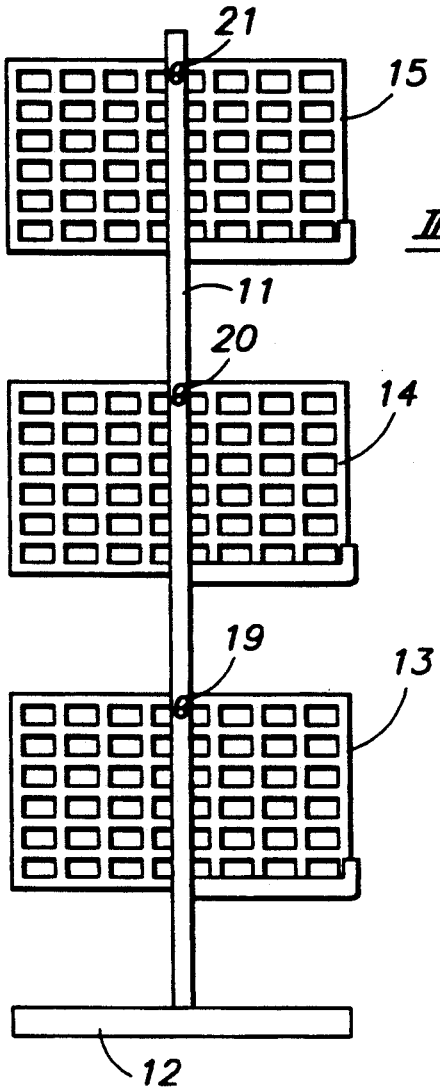
FIG. 1 is an orthographic side view of the invention.
Figure 2:
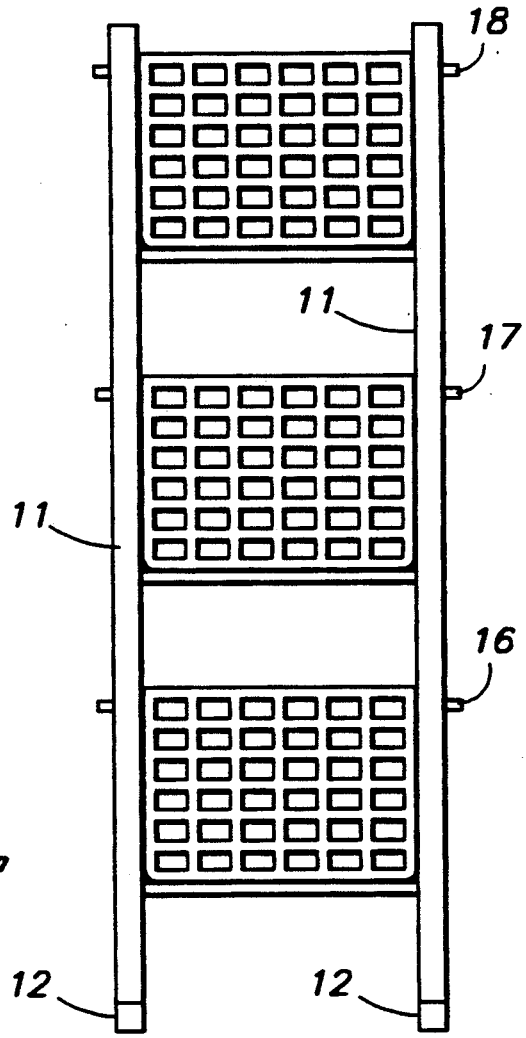
FIG. 2 is an orthographic frontal view, taken in elevation, of the invention.
Figure 3:
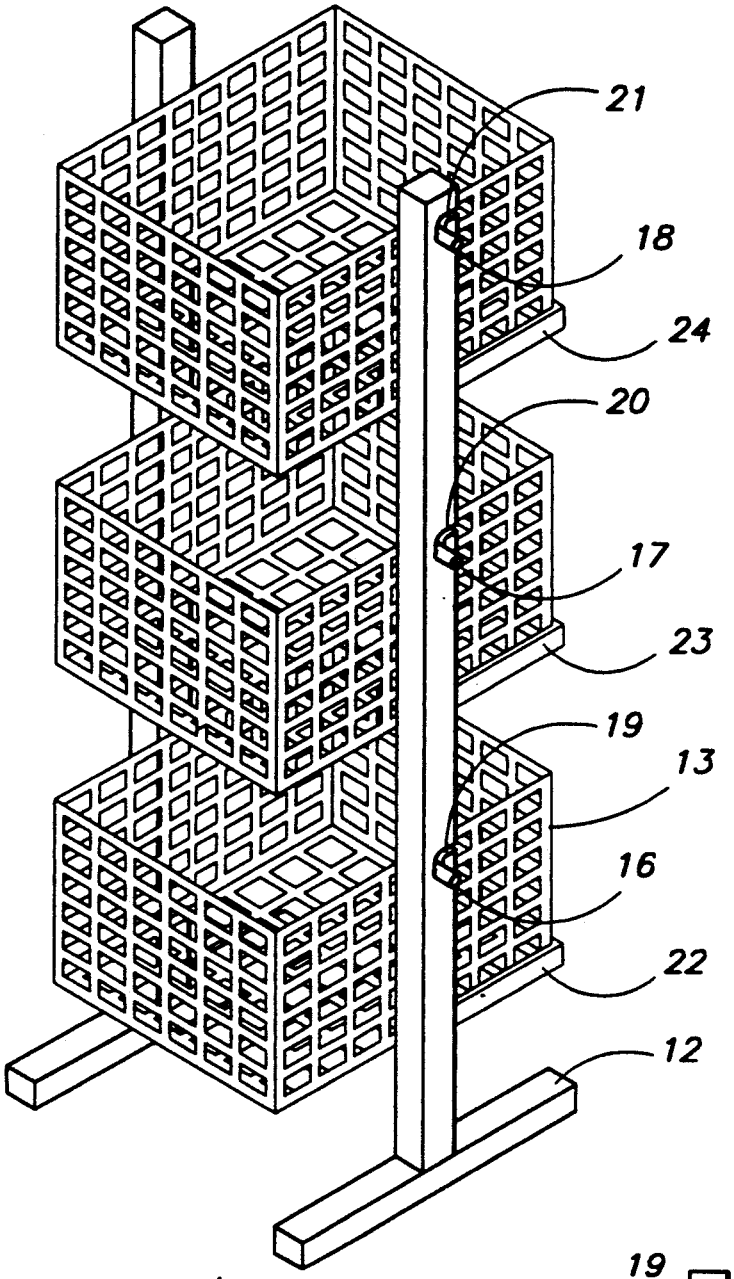
FIG. 3 is an isometric illustration of the instant invention.
Figure 4:
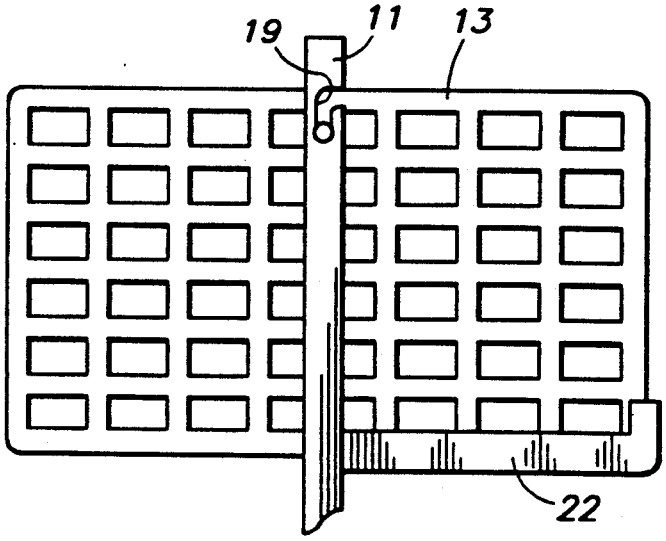
FIG. 4 is an orthographic side view of an enlarged detail illustrating the pivotal securement of a basket relative to the vertical supports.

With reference now to the drawings, and in particular to FIGS. 1 to 8 thereof, a new and improved multiple laundry basket apparatus embodying the principles and concepts of the present invention and generally designated by the reference numerals 10 and 10*a* will be described.

Figure 5:
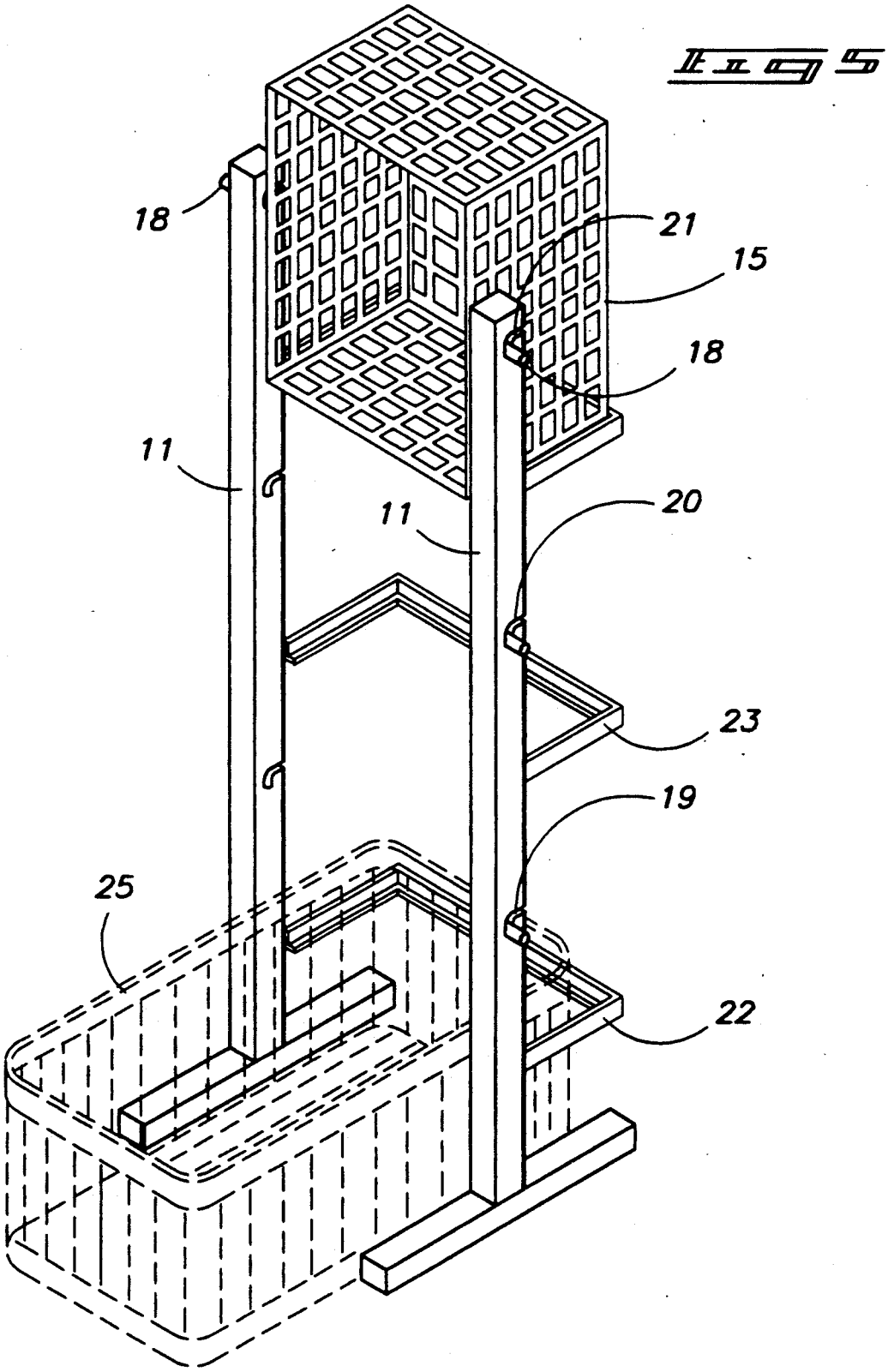
FIG. 5 is an isometric illustration of the invention illustrating the baskets in a pivoted arrangement to direct garments to an underlying clothes hamper.

More specifically, the multiple laundry basket apparatus 10 of the instant invention essentially comprises a plurality of support posts 11 that are arranged coextensively and parallel relative to one another in a spaced relationship, each including a pedestal 12 fixedly and orthogonally mounted to a lower terminal end of each support post 11. A respective first, second, and third basket 13, 14, and 15 respective, each formed of a lattice work, each include a respective pair of first, second, and third pivot axles 16, 17, and 18, wherein each pair of pivot axles are arranged coaxially relative to one another and are aligned in opposite sides of each basket about an upper entrance of each basket, wherein each of the respective of the first, second, and third pivot axles are received within respective first, second, and third "L" shaped slots 19, 20, and 21, as illustrated in more detail in FIG. 5 for example. The "L" shaped slots each include an entrance through a side wall of each support post permitting removal of the baskets relative to the support post, as well as pivotment of each basket relative to the support post. To maintain horizontal alignment of the baskets, each basket includes a respective first, second, and third "U" shaped bracket 22, 23, and 24 respectively, wherein each bracket is arranged parallel relative to one another and orthogonally relative to the support posts 11. The "U" shaped brackets complementarily receive a bottom portion of each respective basket therewithin. When emptying of the baskets are desired, a laundry hamper 25 is positioned between the posts 11, as illustrated in FIG. 5, wherein pivotment of each basket permits sequential emptying of each basket into the underlying hamper, wherein each basket is subsequently removed subsequent to its emptying into the underlying hamper.

Figure 6:
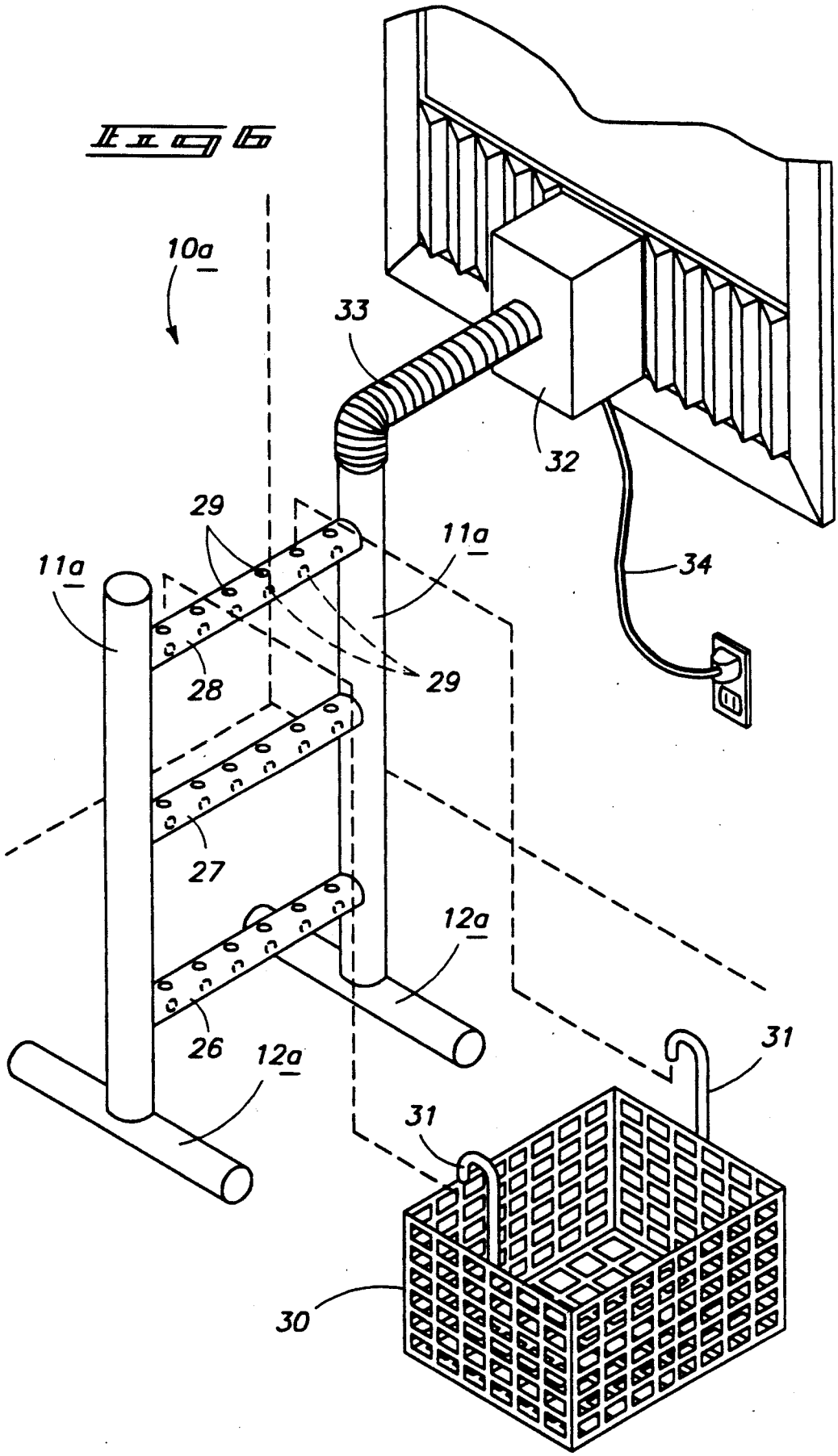
FIG. 6 is an isometric illustration of a modification of the invention.
Figure 7:
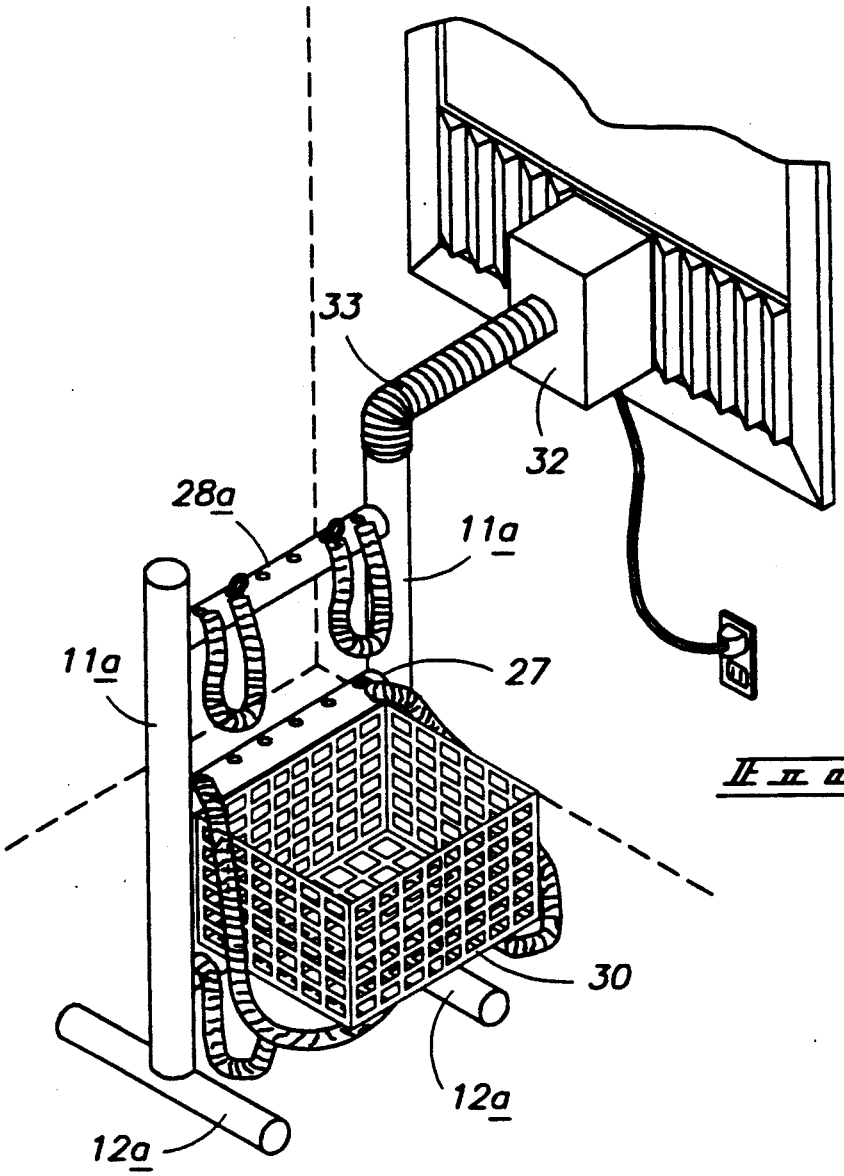
FIG. 7 is an isometric illustration of a further construction of the invention.
Figure 8:
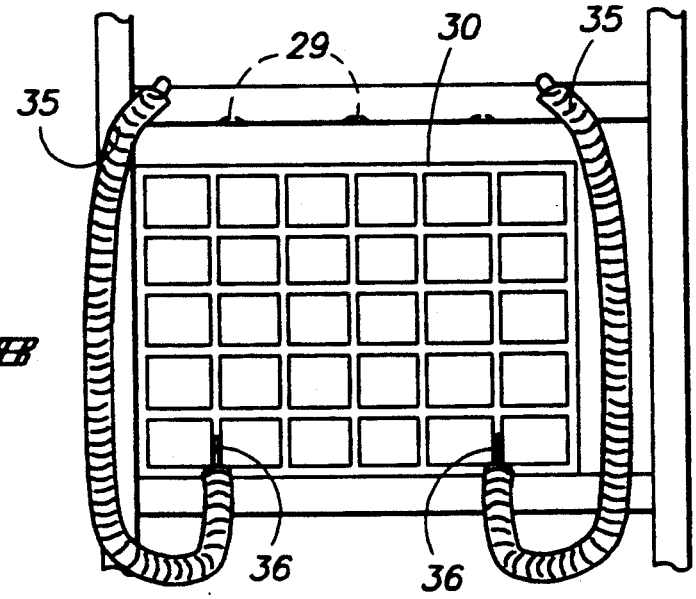
FIG. 8 is an orthographic side view, taken in elevation, illustrating detail of the auxiliary ventilation conduits utilized by the invention, as set forth in FIG. 7.

FIGS. 6-8 illustrate a modified structure 10*a*, wherein in addition to the modified support posts 11*a* that are formed of a hollow tubular configuration, a respective first, second, and third tubular cross brace 26, 27, and 28 are in pneumatic communication with each of the modified support posts 11*a*. Each cross brace includes a plurality of upper and lower ventilation apertures 29 directed diametrically through the cross braces to accommodate ventilation and removal of undesirable fumes utilizing exhaust fan 32, including a flexible connecting conduit 33 communicating the exhaust fan 32 with one of the tubular conduits 11*a*. The remaining tubular conduit 11*a* has its upper terminal end capped requiring ventilation through the ventilation apertures and thereby exhausting various undesirable fumes relative to the baskets utilized. The baskets 30 utilized by the apparatus, as illustrated in FIG. 6, include "J" shaped hooks 31 mounted to the upper rim or entrance of the basket extending orthogonally upwardly therefrom and are spaced apart a predetermined spacing substantially equal to the predetermined spacing spaced apart by a plurality of ventilation apertures 29 to provide fixed securement of the basket within the ventilation apertures, alternatively, the "J"shaped hooks may be positioned to receive an associated cross brace within the "J" shaped hooks cavity.

The structure of FIGS. 7 and 8 illustrate optional ventilation conduits 35 in pneumatic communication with the upper ventilation apertures 29, wherein the ventilation conduits 35 are of flexible construction and include a conduit hook member 36 mounted at a lower terminal end of each auxiliary ventilation conduit 35, wherein the conduit hook members 36 are securable within the lattice work of each respective basket to provide ventilation at desired orientation points relative to each basket, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multiple laundry basket apparatus, comprising, a plurality of spaced parallel support posts arranged coextensively relative to one another, with each support post including a support post pedestal fixedly and orthogonally mounted to a lower terminal end of each support post, the support posts spaced apart a predetermined spacing, and a plurality of basket members pivotally mounted between the support post, the basket members defined by a predetermined width substantially equal to or less than the predetermined spacing, and each basket including mounting means for pivotally mounting each basket between the support posts, and the mounting means includes a tubular cross brace orthogonally and fixedly mounted between the support posts, wherein the plurality of baskets is defined by a predetermined number, and a predetermined number of tubular cross braces are provided to accommodate the predetermined number of baskets, and the tubular cross braces and the support posts are hollow, and each tubular cross brace includes a plurality of upper and lower ventilation apertures diametrically opposed relative to one another directed across the top and bottom surfaces of each tubular cross brace and one of said support posts includes a flexible connecting conduit connecting an upper terminal end of the at least one support post in pneumatic communication with an exhaust fan, wherein the exhaust fan is directed to effect ventilation through the support posts and in surrounding relationship relative to each tubular cross brace.

2. An apparatus as set forth in claim 1 wherein the mounting means further includes a plurality of "J" shaped hooks, wherein the "J" shaped hooks are mounted to an upper end medially of each basket, and the "J" shaped hooks are arranged for securement to an associated tubular cross brace.

3. An apparatus as set forth in claim 2 wherein at least one auxiliary ventilation conduit is mounted to one of said ventilation apertures, and a conduit hook member is mounted to the said at least one auxiliary ventilation conduit for securement to an associated basket.

* * * * *